US007758447B2

(12) United States Patent
Sugimae

(10) Patent No.: US 7,758,447 B2
(45) Date of Patent: Jul. 20, 2010

(54) GOLF CLUB GRIP

(75) Inventor: Ryuichi Sugimae, Oceanside, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

(21) Appl. No.: 12/082,080

(22) Filed: Apr. 7, 2008

(65) Prior Publication Data

US 2009/0253530 A1 Oct. 8, 2009

(51) Int. Cl.
*A63B 53/16* (2006.01)

(52) U.S. Cl. ..... 473/303

(58) Field of Classification Search ..... 473/300–303
See application file for complete search history.

(56) References Cited

U.S. PATENT DOCUMENTS

| | | | | |
|---|---|---|---|---|
| 1,488,900 | A | 4/1924 | Armstrong | |
| 1,532,679 | A | 4/1925 | Bradley | |
| 3,706,453 | A | 12/1972 | Rosasco, Jr. | |
| 4,065,127 | A | 12/1977 | Fagan | |
| 5,897,440 | A | 4/1999 | Bae et al. | |
| 6,004,224 | A * | 12/1999 | Tanaka | 473/297 |
| 6,174,244 | B1 | 1/2001 | Zimmerman | |
| 6,210,289 | B1 | 4/2001 | LaBrake | |
| 6,511,386 | B1 | 1/2003 | Cacicedo | |
| 6,540,621 | B1 | 4/2003 | Robinson | |
| 6,923,727 | B1 | 8/2005 | Jacobs | |
| 7,635,310 | B2 * | 12/2009 | Keough | 473/297 |
| 2003/0084756 | A1 * | 5/2003 | Schroder et al. | 81/20 |
| 2006/0068148 | A1 | 3/2006 | Ulrich | |

* cited by examiner

*Primary Examiner*—Stephen L. Blau
(74) *Attorney, Agent, or Firm*—Klarquist Sparkman, LLP

(57) ABSTRACT

A golf club has a hand grip comprising an exterior surface and an interior surface with an elongated bore located between the two surfaces and extending generally parallel to the golf club shaft. A removable shim with a generally arc shaped cross section is disposed inside of the bore and forms a "reminder rib" for a player using the club.

11 Claims, 3 Drawing Sheets

GOLF CLUB GRIP

FIELD

The present disclosure relates to golf club grips. More specifically, the present disclosure relates generally to golf club gripping devices and more particularly to golf clubs including a reminder rib disposed therein.

BACKGROUND

Golf club grips commonly include a reminder rib to help a player properly orient his or her hands on the club. A rib can be either placed against the palm or fingers (e.g., index finger, thumb, or some other finger). By using a reminder rib a person can train himself to have a neutral address position, meaning that a golf club is held at a neutral angle relative to a golf ball. With this orientation, the ball is more likely to fly straight as opposed to curving in one direction or the other when the club face is "open" or "closed." Alternatively, a reminder rib can serve as a reference for golfers who deliberately choose to open or close the club face to compensate for his/her swing, golf course layout, weather, or other factors. For example, a club with a deliberately closed face could assist players in hitting the ball to the left side of the fairway from the player's point of view, or reducing slicing. Additionally, an open face would tend to help a player to hit high cut shots, eliminate hook shots caused by an outside-in swing (e.g., the player bringing the club closer to the player's body through the course of the swing), or keeping the ball on the right side of the fairway instead of the left side of the fairway from the player's point of view. By adjusting whether the club face is open or closed, the player can change the ball flight trajectory or compensate for a tendency to hit to the left side or right side of the fairway or green.

Additionally, a closed face on a golf club would tend to generate a lower flight trajectory which could be desirable if there was a strong wind. This lower trajectory also causes the golf ball to roll more once it lands on the fairway or green. By contrast, an open faced golf club generally causes the ball to fly higher. This higher trajectory can cause the ball to roll less once it lands, thus enabling a player to "place" the golf ball on the fairway or green.

US Patent App. No. 2006/0068148 A1 to Ulrich discloses a method of forming a reminder rib in a grip, wherein an adhesive strip is placed between the grip and golf club shaft. One drawback of this approach is that it is very difficult to change the position or shape of the reminder rib without re-gripping the club because the rib is adhered to the shaft.

U.S. Pat. No. 6,511,386 to Cacicedo discloses a golf club grip having one or more pre-bored and pre-shaped holes configured to accept a stiffening rod. This grip has the drawback of only accepting rods of a given shape in a limited number of incrementally separated positions.

The present disclosure is aimed at resolving these and other associated problems known to those skilled in the art.

SUMMARY

In one embodiment, the present disclosure describes a golf club grip comprising a generally elongated cylindrical member including an exterior surface and an interior surface that defines a shaft receiving space extending end to end through the cylindrical member. The receiving space forms an upper end opening and a lower end opening. The cylindrical member further includes a grip section defined by a portion of the exterior surface and the interior surface. The grip section includes a slot extending at least a portion of the length of the grip section and having a longitudinal axis that is generally parallel to the axis of the cylindrical member. A shim is generally disposed inside the slot, and extends at least partially through the grip section where the club is gripped. The shim preferably has a generally arc-shaped cross-section with an inner surface and an outer surface. The shim and slot are configured such that the shim is removable from the slot. Preferably, the slot and shim are sized and shaped and formed of materials that allow the shim to be snugly inserted into and removed from the slot and yet remain securely in place, with minimal shifting or angular movement, when the club and grip are subject to forces generated by a golf swing.

Another embodiment of the present disclosure describes a golf club comprising a shaft, a club head affixed to one end of the shaft, and a grip located around at least a portion of another end of the shaft. The grip section includes a slot extending at least a portion of the length of the grip section and having an axis that is generally parallel to the axis of the shaft. The grip section also includes a shim generally disposed inside the slot. The shim is about the length of the grip section and has a generally arc-shaped cross-section with an inner surface and an outer surface. The shim and slot are configured such that the shim is removable from the slot.

Yet another embodiment of the present disclosure describes a golf club grip comprising a generally elongated cylindrical member including an exterior surface and an interior surface. The cylindrical member defines a shaft receiving space extending end to end through the cylindrical member and forming an upper end opening and a lower end opening. The cylindrical member further includes a grip section defined by a portion of the exterior surface and the interior surface. The grip section includes a slot having a bore disposed between the exterior surface and the interior surface, which extends at least a portion of the length of the grip section and has a longitudinal axis that is generally parallel to the axis of the cylindrical member. A shim is disposed generally inside the bore and preferably extends at least the length of the grip section. The shim preferably has a generally arc-shaped cross-section with an inner surface and an outer surface, and further includes an elongated ridge disposed along the length of the outer surface. The elongated ridge is generally parallel to the longitudinal axis of the bore. In one embodiment, the arc-shaped cross section of the shim covers an arc of roughly 10°. Furthermore, the elongated ridge causes no more than 1 mm variance between a narrowest portion of the grip section and a thickest portion of the grip section when the shim is inserted into the grip section. Finally, the bore and shim are configured such that the shim is removable from the bore.

The foregoing and other objects, features, and advantages of the invention will become more apparent from the following detailed description, which proceeds with reference to the accompanying figures.

DETAILED DESCRIPTION

Figure 1:
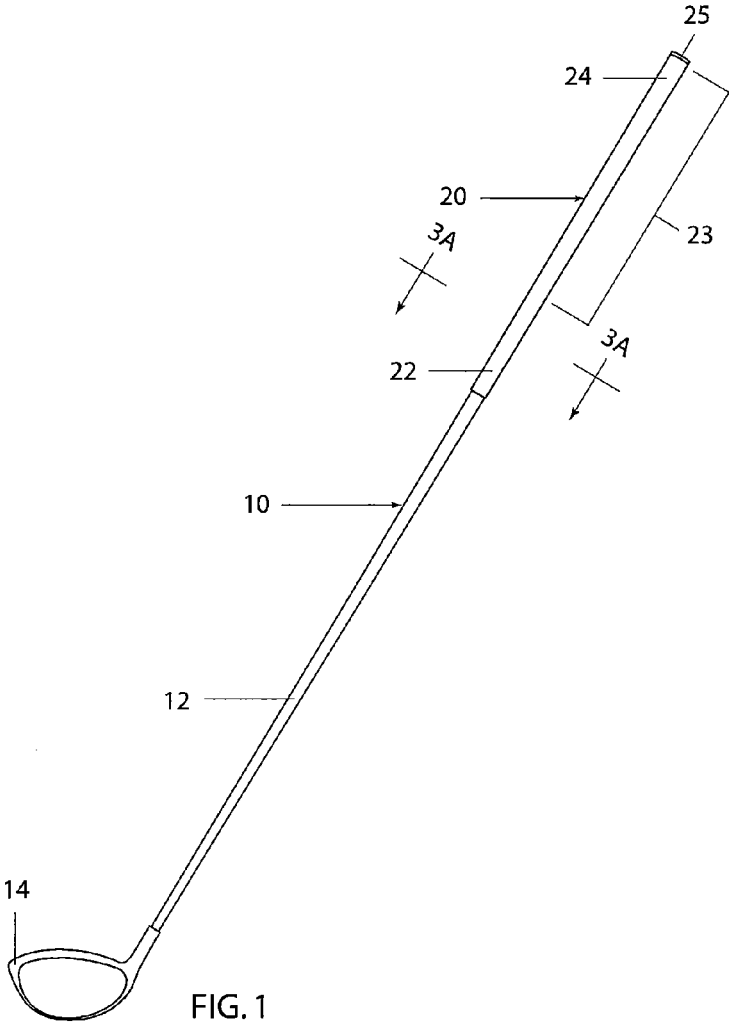
FIG. 1 is a perspective view of a golf club according to one embodiment of the present description.

FIG. 1 illustrates a golf club 10 having a shaft 12, a club head 14, and a golf club grip 20. The golf club grip 20 includes a bottom portion 22, a grip section 23, a top portion 24, and a grip cap 25. The grip section refers to the area of the grip where the player's hands typically grip the club. It will be appreciated that the grip section may vary along the length of the grip, depending on the particular golfer or shot. Some golfers, for example, routinely "choke up" on the club or choose to choke up for a particular shot. Certain embodiments of this disclosure can be used in a golf club grip 20 for any type of golf club 12 including a metalwood, an iron or a utility club.

Figure 2:
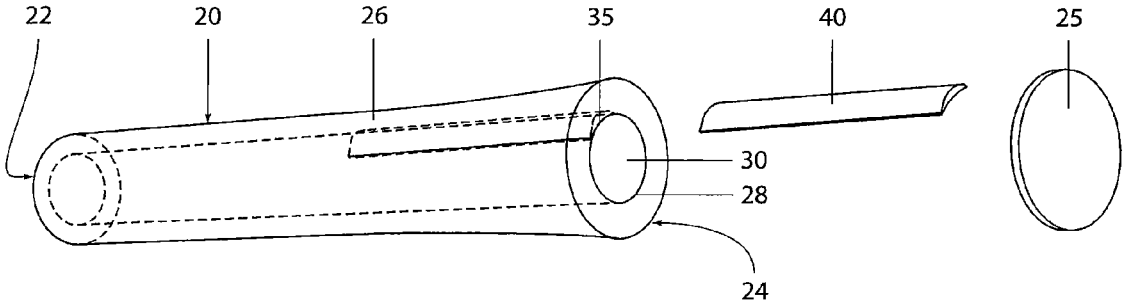
FIG. 2 is an exploded perspective view of a golf club grip according to the embodiment of FIG. 1.

FIG. 2 illustrates a disassembled view of the grip 20 according to the present disclosure. The grip 20 includes an outer surface 26 and an inner surface or shaft wall 28. The thickness of the grip 20 may gradually decrease from the top portion to the bottom portion, giving the outer surface a slight taper from the top portion to the bottom portion and a more aesthetic transition from the grip to the shaft 12 (see FIG. 1). The inner surface 28 defines a shaft receiving space 30 through which the golf club shaft 12 can be inserted. The grip 20 further includes a slot having a bore 35 located between the outer surface 26 and the inner surface 28. In one embodiment it is envisioned that the bore 35 extends substantially the entire length of the grip 20. In another embodiment, the bore 35 extends to within three inches of the bottom portion 22 of the grip 20, which is the minimum length that is currently allowed according to the USGA rules and generally corresponds to the grip section.

An elongated shim 40 that preferably is about the same length and shape as the bore 35 is inserted inside the bore 35 to form a tactile reminder or angular reference point to a person gripping the golf club 10. The shim typically has a hardness that exceeds the hardness of the grip, such that the grip is relatively soft in comparison to the shim. When inserted in the bore 35, the shim creates a slight bulge in the outer surface of the grip 20, a harder tactile feel in the adjacent outer surface of the grip 20, or both, in order to give the golfer a tactile longitudinally extending frame of reference for the golfer to align his or her hands in a desired position on the club. In a preferred embodiment, the shim 40 is not adhered to the inside of the bore 35 and is therefore removable. In this embodiment, the shim 40 is generally held inside the bore 35 due at least partially to friction resulting from the compressive force of the grip 20 around the shim. In this embodiment the grip cap 25 covers the top portion 24 of the grip 20, and may serve as one additional method of holding the shim 40 inside the bore 35.

In a preferred embodiment, the shim 40 fits almost entirely inside the bore 35. In an alternative embodiment the shim 40 may project slightly from the bore 35. The grip cap 25 in this embodiment would include a slight recess to accommodate the projecting portion of the shim 40. The projecting shim 40 would be easier to grasp and remove with fingers, pliers, or some other instrument. Additionally, in certain embodiments the shim 40 may include one or more holes or indentations on one or both ends of the shim so as to facilitate removal with a tool or tools. For example, if the shim 40 has a hole on the end, then a tool may have a spike or other protrusion that fits inside the hole and assists a user in pulling the shim from the bore 35.

Figure 3:
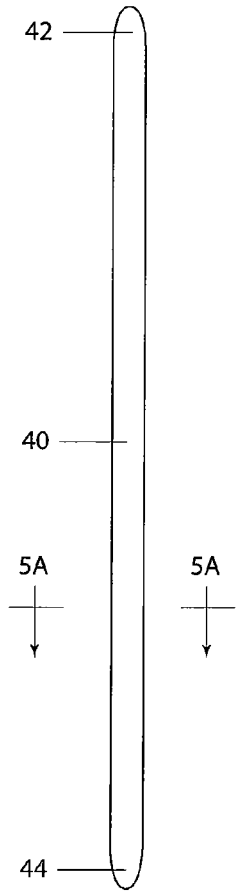
FIG. 3 is an elevation view of a shim according to the embodiment of FIG. 1.

FIG. 3 illustrates shim 40, which is substantially linear and includes a top part 42 and a bottom part 44. In one embodiment the top part 42 and the bottom part 44 of the shim 40 are tapered so as to assist in insertion and removal of the shim 40 from the bore 35. In another embodiment one or both of the top part 42 and bottom part 44 are not tapered. The shim typically has a generally smooth surface to facilitate its insertion and removal from the bore 35. In one embodiment the shim may have a Teflon® or other friction reducing coating to facilitate sliding the shim into and out of the shim-receiving bore. However, in other embodiments, at least a portion of the shim may have a rough surface. The rough surface may increase the friction between the shim and the interior surfaces of the slot, which may aid retention of the shim in the bore.

In certain embodiments, it is envisioned that the shim 40 may be made out of, or coated with, plastic, aluminum, graphite, stainless steel, or any other substance that would be known to be suitable in the art. For example, the shim 40 may be selected to be a certain material based upon the weight characteristics of that material and a desire to keep the total weight of the golf club 10 below a certain maximum weight. Alternatively, the material for the shim 40 may be selected based upon other characteristics such as stiffness or tactile "give" of the material.

Figure 3A:
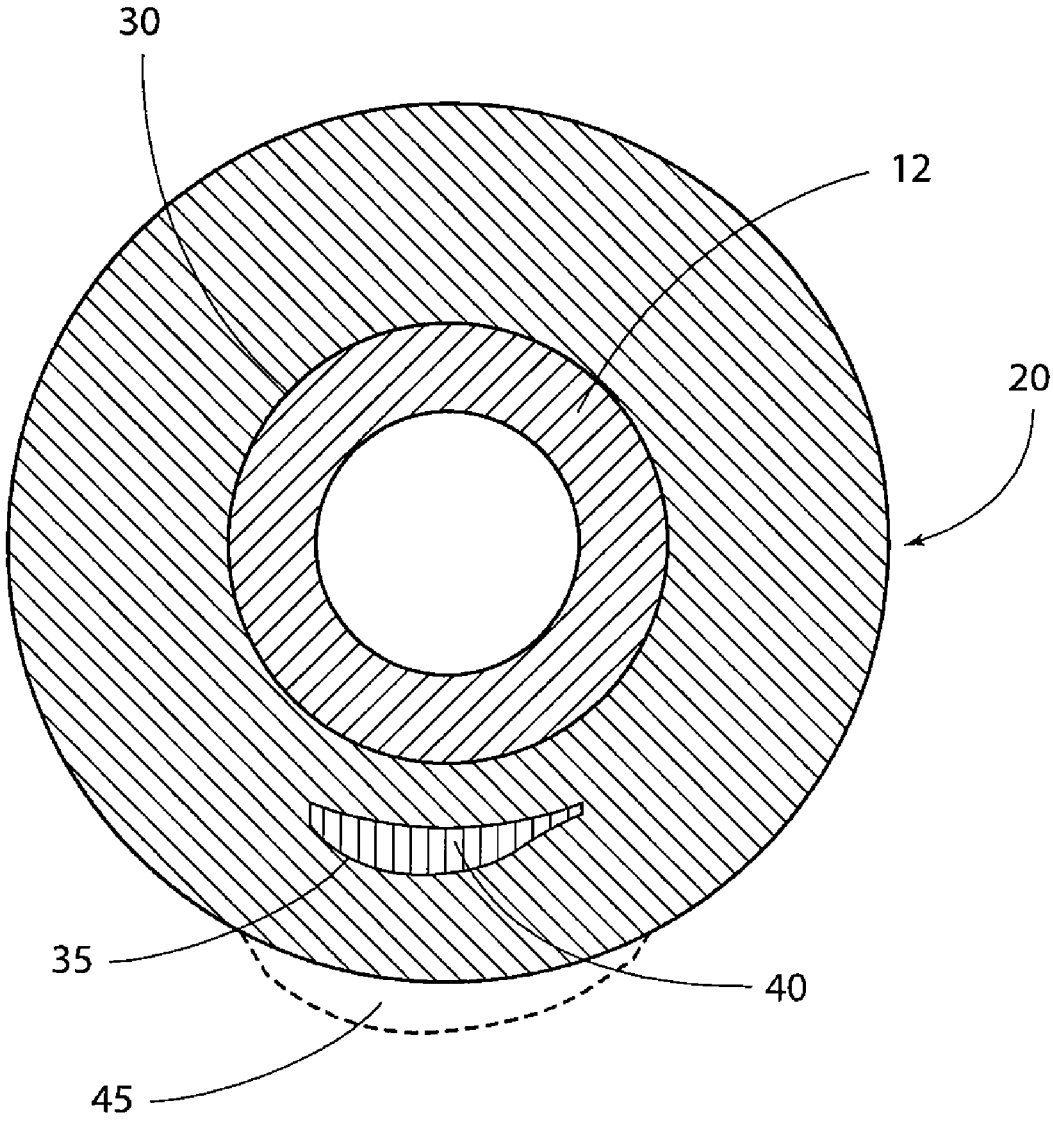
FIG. 3A is an enlarged cross sectional view taken along line 3A-3A of FIG. 1.

FIG. 3A shows the shaft 12 coaxially located within the shaft receiving space 30 of the grip 20. In this illustration, the shim 40 is shown occupying the space provided by the bore 35. In one embodiment, the shim is sized to slightly deform the grip to create a raised rib which runs vertically along the length of the grip 20 and is indicated by the dotted outline 45 in FIG. 3A. Outline 45 is an exaggerated illustration of the raised rib formed when the shim is sized to expand the outer surface of the grip. In an alternative embodiment, the grip 20 remains circular and does not deform, but a tactile difference is felt by the hand or fingers of a player using the grip.

Figure 4:
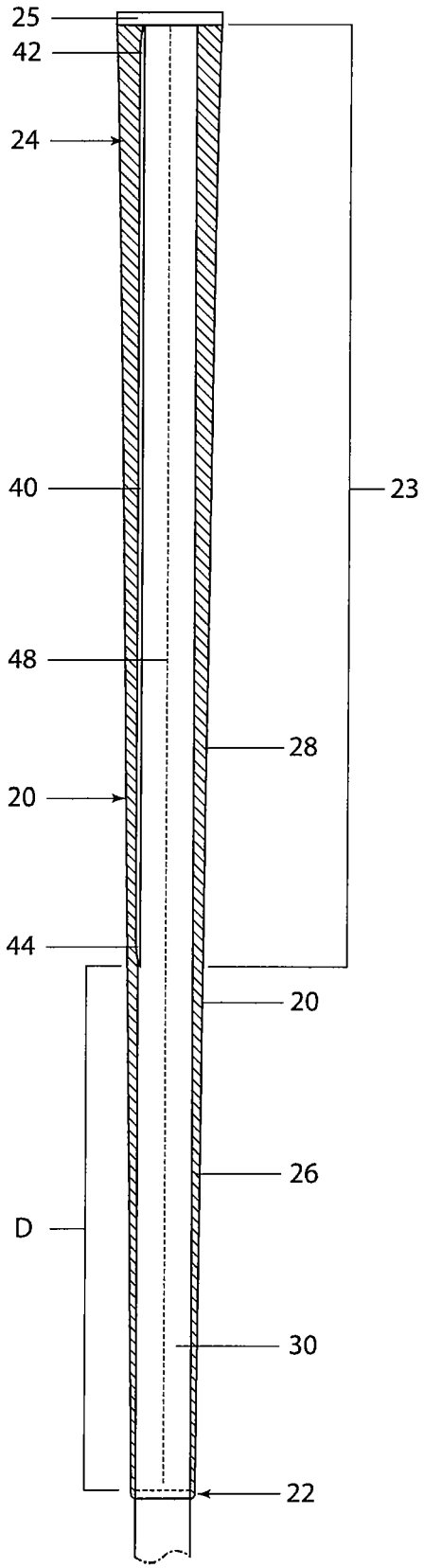
FIG. 4 shows a longitudinal cross-sectional view of a golf club grip of FIG. 1.

FIG. 4 illustrates a cross-sectional view of one embodiment of the grip 20. The top part 42 of the shim 40 is generally aligned with the top portion 24 of the grip 20. As described above, the bottom part 44 of the shim 40 is separated from the bottom portion 22 of the grip 20 by a distance D. It can be further seen that the grip 20 and the shim 40 are generally parallel to one another and with the longitudinal axis 48 of the shaft 12. FIG. 4 also illustrates how the outer surface of the grip preferably is tapered as the grip extends from the end of the club toward the club head.

Figure 5A:
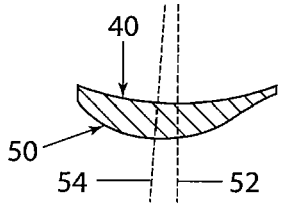
FIG. 5A is a cross-section view of the shim of FIG. 3 taken along line 5A-5A of FIG. 3.

FIG. 5A illustrates a cross-section of a preferred embodiment of the shim 40 taken along line 5A-5A of FIG. 2, the shim preferably having a generally arcuate shape with a radius of curvature corresponding generally to the radius of the bore of the grip. It can be seen that the shim 40 includes a raised portion 50 along one outwardly facing side. The raised portion or bulge preferably extends the full length of the shim. In one embodiment the angle between a midpoint 52 of the shim 40 and apex 54 of the raised portion 50 is between 0 and about 15°, preferably about 5° to 15°, and most preferably about 5° to 10°. The shims may be offered to golfers individually or with one or more shims grouped together as a kit. Other options might include offering one or more shims with the grip or with a given club (e.g., a driver or a specific iron or wood) as a set. An exemplary kit might include two shims having an angle between a midpoint of the shim and the apex of 5° and 10°, another kit might include three shims of 5°, 8° and 12° and so on, although other kits may include shims varying by smaller degree increments such as 1° increments.

A difference of 5° in how a user holds a club can make a noticeable difference in the flight path of the golf ball. However, a player may prefer a grip reminder orientation that falls between two preset orientations offered by prior art grips (see Cacicedo grip as described above), requiring the player to choose the best of the limited options available. By providing a plurality of different shims that vary by increments as small as 1°, a player's options are increased and the player can choose which option is preferable for the given course, weather, or conditions related to a specific player.

The club grip 20 preferably is adhesively bonded to the shaft 12 which is received within the shaft receiving space 30 of the club grip. Once the grip is in place, the shim 40 is inserted into the bore 35 of the club grip 20, and the grip cap 25 is affixed to the end of the club grip 20. As mentioned above, the grip cap 25 may prevent the shim 40 from sliding out of the club grip 20 during use.

With the shim 40 in place, the grip has a longitudinally extending bulge on one side due to an increased radial thickness caused by the shim. Preferably, the radial difference is 1 millimeter or less between the thinnest and thickest walls of the grip, so as to stay in conformance with United States Golf Association (USGA) rules. Generally the narrowest radial section is measured as the shortest distance from the axis of the golf club 10 to the outer surface 26 of the club grip 20, and the thickest radial section is measured as the greatest distance from the axis of the golf club to the outer surface of the club grip. The bulge serves as a reference point or reminder to allow the golfer to align his/her grip in a desired orientation relative to the club head/face. The location/orientation of the "reminder" may vary from golfer to golfer, depending on many factors including preference for an open, closed or neutral club face, desired flight path of the ball, type of course, desire to counter flawed swing mechanics, desired location of reminder relative to golfer's hands, etc. For example, the club grip 20 may be adhered to the shaft 12 such that a user holding the club grip 20 in a normal fashion will align the crease of his or her top hand with the shim 40. In another example, the club grip 20 is adhered to the shaft 12 such that the user aligns his or her top thumb with the shim 40. In yet another example, the shim 40 may be aligned with the palm of the user's top hand.

It will be understood that a club grip 20 having a shim 40 with a 5° angle as described above may cause a user holding the grip 20 to rotate the club face 14 by 5° when the user swings the golf club 10, thus slightly "opening" or "closing" the club face 14, depending on whether the shim reminder is positioned 5° clockwise or counterclockwise relative to a "neutral" grip position. This could be desirable to correct an error in the user's swing or to compensate for wind conditions, ball placement, course layout, or other conditions. It will be noted that though this correction factor is relatively small, and for inexperienced golfers would feel similar to a club grip 20 with a shim 40 with no correction angle, it would still have a noticeable effect on the flight of the golf ball in many instances. It will be further appreciated that because the shim 40 extends parallel to the longitudinal axis of the shaft, a shim 40 with a 5° angle could either "open" or "close" the club face 14 with respect to a golf ball depending on whether the top part 42 or the bottom part 44 of the shim 40 is inserted into the bore 35 first. This feature is due to the 5° asymmetrical offset bulge integrated into the design of the shim. When one end of the shim is inserted into the grip, an elongated reminder reference is provided with a 5° offset (for example) on one side of the shim's neutral center line, and when the opposite end is inserted the reminder reference is provided with a 5° angular offset on the other side of the insert's neutral center line.

Figure 5B:
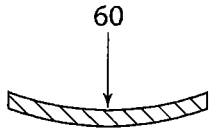
FIG. 5B is a cross-section of another embodiment of the shim.

FIG. 5B shows an alternative embodiment of a shim 60. It can be seen that shim 60 is generally symmetrical and does not include a raised portion 50. In this embodiment the shim 60 is made out of a relatively hard material such as plastic, and the grip 20 is made out of a relatively soft material such as rubber. Inserting the relatively flat shim 60 into the grip 20 creates a tactile hardness difference in different portions of the grip 20 without raising an outer surface portion of the grip. Thus, a user could use this tactile hardness difference as a cue or reference for positioning his or her hands on the grip without changing the size or shape of the golf club grip 20.

The golf club and club grip with the adjustable shim as presented provide for various advantages. One such advantage of using an easily removable and adjustable shim to create a reminder rib is that adjustments to a player's grip can be made quickly and easily. While USGA Rule 4-2(a) prohibits changing the characteristics of a club during a stipulated round, a player may desire to change the reminder rib orientation between rounds due to different weather or course conditions. For example, a player's swing or conditions of a given golf course may change from day to day. In this situation, a player can test reminder ribs at different positions at a driving range to determine which reminder rib position provides the best correction for the conditions of a particular day. That way, a player can ensure with the performance of the golf club is optimized.

Additionally, a player can use the shim as a training tool and gradually reduce the offset of the reminder rib as the player's skill at holding and swinging a club in a level and accurate manner improves.

Another advantage is that this removable shim as disclosed can be used in a grip for any club including a metalwood, an iron or a utility club. Previous technology that assisted in correcting for course conditions or a given player's swing, such as TaylorMade's Movable Weight Technology™ (MWT®), is generally only available in certain clubs or categories of clubs. The present disclosure presents several additional options to a player to improve his or her swing and ball control, either as a stand alone option or in conjunction with the TaylorMade's Movable Weight Technology™ (MWT®).

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

I claim:

1. A golf club grip comprising:

a generally elongated cylindrical member including an exterior surface and an interior surface defining a shaft receiving space extending end to end through the cylindrical member and forming an upper end opening and a lower end opening;

the cylindrical member further including a grip section defined by a portion of the exterior surface and interior surface;

the grip section including a bore extending at least a portion of the length of the grip section and having a longitudinal axis that is generally parallel to the axis of the cylindrical member; and a removable shim generally disposed inside the bore, the shim having a generally arc-shaped cross-section and an inner surface and an outer surface, said shim is asymmetrical, said shim includes an elongated ridge on the outer surface, and said ridge includes an apex that is offset from a midpoint of the shim.

2. The golf club grip of claim 1, wherein said elongated ridge on the outer surface generally extends the length of the shim.

3. The golf club grip of claim 2, wherein the inner surface of the shim proscribes an arc of at least 10°.

4. The golf club grip of claim 2, wherein the inner surface of the shim proscribes an arc of at least 20°.

5. The golf club grip of claim 2, wherein the inner surface of the shim proscribes an arc of at least 30°.

6. The golf club grip of claim 2, wherein the golf club grip has no more than a variance of about 1 mm between a narrowest radial section of the golf club grip and the thickest radial section of the golf club grip.

7. The golf club grip of claim 2, wherein said apex is less than or equal to about five degrees from a midpoint of the shim.

8. The golf club grip of claim 2, wherein the grip includes a top portion and a bottom portion, and the shim includes a top portion and a bottom portion, and the top portion of the shim is generally aligned with the top portion of the grip, and the bottom portion of the shim is within three inches of the bottom portion of the grip.

9. A method of forming a golf club with an adjustable reminder rib, the method comprising:

attaching a generally elongated cylindrical member including an exterior surface and an interior surface defining a shaft receiving space extending end to end through the cylindrical member and forming an upper end opening and a lower end opening, wherein the generally elongated cylindrical member further includes a bore extending end to end through the cylindrical member;

attaching a golf club head to the golf club shaft; and inserting a removable shim into the bore, the shim having a generally arc-shaped cross-section and an inner surface and an outer surface, said shim is asymmetrical, said shim includes an elongated ridge on the outer surface, and said ridge includes an apex that is offset from a midpoint of the shim.

10. The method of claim 9, wherein the elongated ridge is generally parallel to the axis of the shaft, and the elongated ridge generally extends the length of the bore.

11. The method of claim 9, wherein the inner surface of the shim proscribes an arc of at least about 10°.

* * * * *